US005966057A

United States Patent [19]

Kintis et al.

[11] Patent Number: 5,966,057

[45] Date of Patent: Oct. 12, 1999

[54] REFLECTION REDUCING DIRECTIONAL COUPLER

[75] Inventors: Mark Kintis, Manhattan Beach; May M. Tan, Torrance, both of Calif.

[73] Assignee: TRW Inc., Redondo Beach, Calif.

[21] Appl. No.: 08/972,596

[22] Filed: Nov. 18, 1997

[51] Int. Cl.[6] ..... H01P 5/16

[52] U.S. Cl. ..... 333/109; 333/115

[58] Field of Search ..... 333/109, 112, 333/113, 115, 116

[56] References Cited

U.S. PATENT DOCUMENTS

| | | | |
|---|---|---|---|
| 4,394,629 | 7/1983 | Kumar et al. | 333/109 |
| 4,673,898 | 6/1987 | Redmond | 333/109 |
| 4,825,177 | 4/1989 | Teague et al. | 330/295 |
| 4,937,541 | 6/1990 | Podell et al. | 333/116 |
| 5,428,320 | 6/1995 | Lindberg et al. | 332/105 |
| 5,504,465 | 4/1996 | Yung et al. | 332/145 |

FOREIGN PATENT DOCUMENTS

| | | | |
|---|---|---|---|
| 1-147904 | 6/1989 | Japan | 333/116 |
| 4-111501 | 4/1992 | Japan | 333/109 |

*Primary Examiner*—Paul Gensler
*Attorney, Agent, or Firm*—Michael S. Yatsko; Connie Thousand

[57] ABSTRACT

A reflection reducing directional coupler provides an output signal from a coupled signal while reducing the effect of an input signal. The directional coupler provides circuitry to divide, phase delay and vectorially add signals to provide coherent output and coupled signals and reduce reflected signals. The directional coupler also provides the capability to input a calibration signal into a system while mininimizing the effect of the calibration signal on the output signal.

25 Claims, 7 Drawing Sheets

REFLECTION REDUCING DIRECTIONAL COUPLER

BACKGROUND OF THE INVENTION

The present invention relates in general to directional couplers which may be the stripline, microstrip, coaxial, MMIC or waveguide type, and more particularly to a directional coupler for providing an output signal and a coupled signal from an input signal while reducing the effects of a reflected signal.

In Radio Frequency (RF) systems, it is often desirable to determine the amplitude of a signal input into the system, a signal present in the system, or a signal output from the system. It is difficult to obtain a direct measurement of these signals; so, directional couplers are placed in RF systems at locations where a determination of the amplitude of a signal is desired. A directional coupler divides an input signal into a coupled signal and an output signal; the amplitude of the coupled signal being proportional to the amplitude of the input and output signals. The amplitude of the input and output signals can thus be determined by measuring the amplitude of the coupled signal. An accurate measurement of the amplitude of the coupled signal is important to an accurate determination of the amplitude of the input and output signals.

A reflected signal can occur at a discontinuity between the directional coupler and an external component (or load) attached to the directional coupler and can distort the coupled signal resulting in an inaccurate measurement of the amplitude of the coupled signal. Therefore, most systems attempt to match the impedance of the output port to the impedance of the load. The closer the impedance match, the lower the amplitude of the reflected signal. However, it is very difficult to match the impedance over an entire frequency band; therefore, typical design techniques match the impedance at a specific desired frequency, and the impedance match degrades as the frequency deviates from that frequency.

For many systems, the inaccuracy of the measurement of the amplitude of the coupled signal is inconsequential to system performance. However, it is anticipated that future systems will be significantly more sophisticated and require a more accurate determination of the amplitude of an input or output signal; inaccuracies of the measurement of the coupled signal induced by a reflected signal will not be acceptable. Therefore, it is desirable to have an improved directional coupler that reduces the portion of the reflected signal that adds to the coupled signal.

SUMMARY OF THE INVENTION

The aforementioned need in the prior art is satisfied by this invention, which provides a directional coupler for producing an output signal and a coupled signal from an input signal while reducing the effects of a reflected signal. The directional coupler provides circuitry for inputting an input signal into an input port of the directional coupler. The input signal is divided into a first and a second intermediate signal. The first intermediate signal is divided into a third and a fourth intermediate signal; and, the second intermediate signal is phase delayed into a first delayed signal. The first delayed signal is divided into a fifth and a sixth delayed signal; and, the fourth intermediate signal is delayed into a second delayed signal. The sixth and second delayed signals are combined and vectorially added into a coupled signal which is provided at the coupled port of the directional coupler.

The third intermediate signal is phase delayed into a third delayed signal. The third delayed signal and the fifth delayed signal are combined and vectorially added into an output signal which is provided at the output port of the directional coupler.

The impedance match between the output port and an external load attached to the output port determines the amplitude of the first reflected signal. The first reflected signal is divided into a second and a third reflected signal. The second reflected signal is phase delayed into a sixth delayed signal; and, the third reflected signal is divided into a fourth and a fifth reflected signal. The sixth delayed signal is divided into a seventh and an eighth delayed signal; and, the seventh delayed signal is phase delayed into a ninth delayed signal. The fourth reflected and ninth delayed signals are combined and vectorially added.

The directional coupler can further include circuitry for inputting a first calibration signal into the coupled port of the directional coupler.

DETAILED DESCRIPTION OF THE INVENTION

Figure 1:
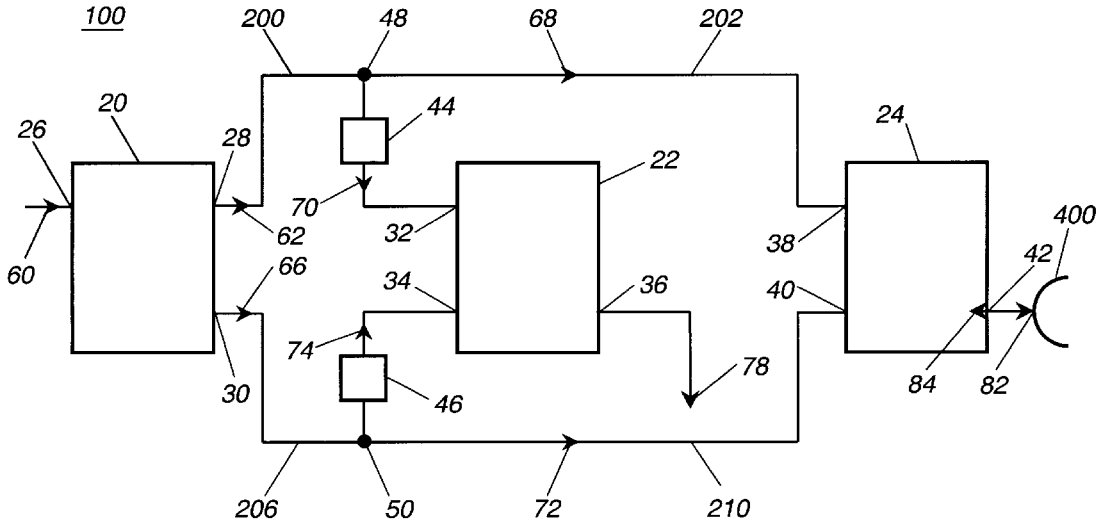
FIG. 1 is a block diagram of the reflection reducing directional coupler in accordance with the invention of this application, illustrating the flow of signals in the forward direction.

The present invention, as illustrated in FIG. 1, relates to a directional coupler 100 for use in a radio frequency (RF)

system and, more particularly, to a directional coupler 100 that provides an output signal 82 and a coupled signal 78 from an input signal 60 while reducing the effects of a first reflected signal 84. It should be understood by those of ordinary skill in the art that the principles of the present invention are applicable to virtually any type of RF system, such as a communication system. The principles of the present invention are also applicable to any number of communication systems, across and including the entire RF spectrum.

The major components of this invention include a first electrical member 20, a second electrical member 22 and a third electrical member 24. The first electrical member 20 includes a input port 26, a second port 28 and a third port 30. The input port 26 is adapted to receive an input signal 60 and provides the means for inputting the input signal 60 into the directional coupler 100.

Figure 2A:
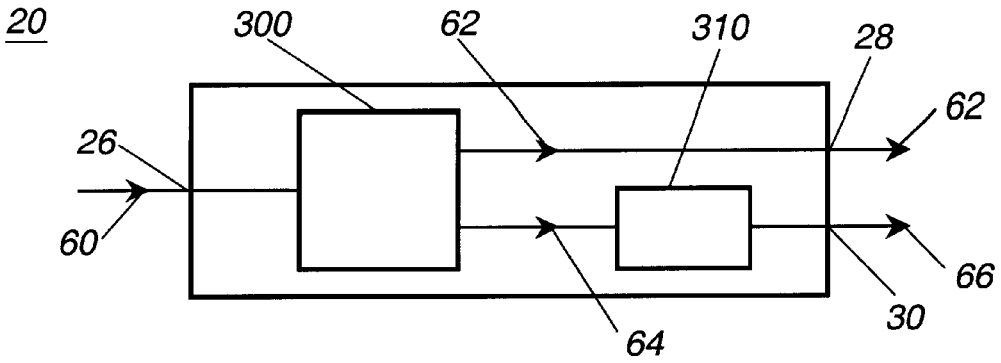
FIGS. 2*a–c* are block diagrams of the first, second and third electrical members of the reflection reducing directional coupler in accordance with the invention of this application, illustrating the flow of signals in the forward direction in the electrical members.

The first electrical member 20 includes means 300 (FIG. 2*a*) to divide the input signal 60 into a first intermediate signal 62 and a second intermediate signal 64 and includes means 310 to phase delay the second intermediate signal 64 to generate a first delayed signal 66. The first intermediate signal 62 is supplied to the second port 28; and, the first delayed signal 66 is supplied to the third port 30.

The second electrical member 22 (FIG. 1) includes a fourth port 32, a fifth port 34, and, a coupled port 36. The third electrical member 24 includes a seventh port 38, an eighth port 40, and, an output port 42. The second port 28 of the first electrical member 20 is electrically connected to the fourth port 32 of the second electrical member 22 via line 200 and the first electrical component 44 and to the seventh port 38 of the third electrical member 24 via lines 200 and 202. The first junction 48, formed by the electrical connection of line 200 with both the first electrical component 44 and line 202, provides the means to divide the first intermediate signal 62 into a third intermediate signal 68 and a fourth intermediate signal 70 each having the same phase as the first intermediate signal 62. Similarly, the third port 30 of the first electrical member 20 is electrically connected to the fifth port 34 of the second electrical member 22 via line 206 and the second electrical component 46 and to the eighth port 40 of the third electrical member 24 via lines 206 and 210. The second junction 50, formed by the electrical connection of line 206 with both the second electrical component 46 and line 210, provides the means to divide the first delayed signal 66 into a second delayed signal 72 and a third delayed signal 74 each having the same phase as the first delayed signal 66.

The first 44 and second 46 electrical components can be resistors, active components, directional couplers, MMIC's, or any other electrical components 44, 46 which are capable of dividing the first intermediate signal 62 into a third 68 and a fourth 70 intermediate signal and dividing the first delayed signal 66 into a second 72 and a third 74 delayed signal respectively. The amplitude of a signal received at the fourth port 32 of the second electrical member 22; and, the amplitude of a signal received at the seventh port 38 of the third electrical member 24 is determined by the electrical characteristics of the first electrical component 44. Similarly, the amplitude of a signal received at the fifth port 34 of the second electrical member 22; and, the amplitude of a signal received at the eighth port 40 of the third electrical member is determined by the electrical characteristics of the second electrical component 46.

Providing first 44 and second 46 components having equal electrical characteristics provides the means to divide the first intermediate signal 62 and the first delayed signal 66 into a third delayed 74 and a fourth intermediate 70 signal having equal relative amplitudes, and, a third intermediate 68 and a second delayed 72 signals having equal relative amplitudes. Note however that the fourth intermediate 70 and third delayed 74 signals differ in phasing and the third intermediate 68 and second delayed 72 signals differ in phasing. This is because the second 72 and third 74 delayed signals have the same relative phase as the first delayed signal 66; and, the third intermediate 68 and fourth intermediate 70 signals have the same relative phase as the first intermediate signal 62.

Figure 2B:
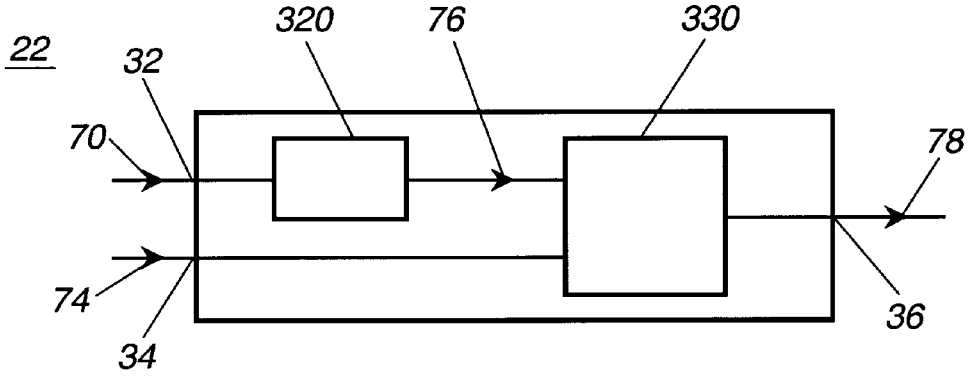

The fourth port 32 and the fifth port 34 of the second electrical member 22 are adapted to receive the fourth intermediate signal 70 and the third delayed signal 74 respectively. The second electrical member 22 includes means 320 (FIG. 2*b*) to phase delay the fourth intermediate signal 70 to generate a fourth delayed signal 76. The second electrical member 22 also includes means 330 to combine and vectorially add the third 74 and fourth 76 delayed signals into a coupled signal 78. The coupled port 36 of the second electrical member 22 provides the means to output the coupled signal 78 from the directional coupler 100.

The seventh port 38 and eighth port 40 of the third electrical member 24 are adapted to receive the third intermediate 68 and the second delayed 72 signals respectively. The third electrical member 24 (FIG. 2*c*) includes means 340 to phase delay the third intermediate signal 68 to generate a fifth delayed signal 80. The third electrical member 24 also includes means 350 to combine and vectorially add the second 72 and fifth 80 delayed signals into an output signal 82. The output port 42 of the third electrical member 24 provides the means to output the output signal 82 from the directional coupler 100.

Figure 2C:
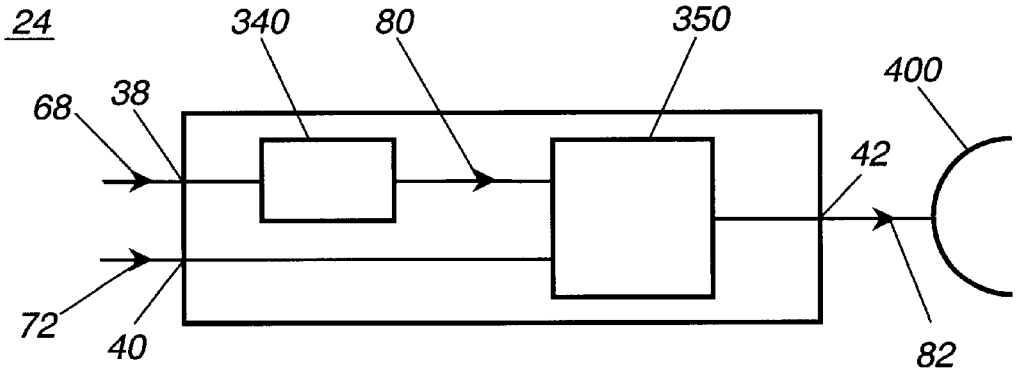

For various system applications, it is desirable to provide a coherent output signal 82 (FIG. 2*c*). Providing second delayed 72 and fifth delayed 80 signals that are in-phase with respect to each other allows for vectorial addition of the two signals into a coherent output signal 82. To accomplish this, means 300 (FIG. 2*a*) divides the input signal into equal amplitude first 62 and second 64 intermediate signals, means 310 phase delays the second intermediate signal 64 ninety degrees to provide a first delayed signal 66 that is ninety degrees phase delayed with respect to the first intermediate signal 62. Junction 48 (FIG. 1) provides the means to divide the first intermediate signal 62 into a third intermediate signal 68 and a fourth intermediate signal 70 each having the same relative phase as the first intermediate signal 62. Similarly, junction 50 provides the means to divide the first delayed signal 66 into a second delayed signal 72 and a third delayed signal 74 each having the same relative phase as the first delayed signal 66. Means 340 (FIG. 2*c*) then phase delays the third intermediate signal 68 ninety degrees resulting in the fifth delayed 80 and the second delayed 72 signals being in-phase with respect to each other, the combining and vectorial addition of which results in a coherent output signal 82.

In addition to a coherent output signal 82, it is desirable to have a coherent coupled signal 78 (FIG. 2*b*) Providing third delayed 74 and fourth delayed 76 signals that are in-phase with respect to each other allows for vectorial addition of the two signals into a coherent coupled signal 78. To provide in-phase third 74 and fourth 76 delayed signals, means 310 (FIG. 2*a*) phase delays the second intermediate signal 64 ninety degrees to provide a first delayed signal 66 that is ninety degrees out-of-phase with respect to the first intermediate signal 62. Junction 48 (FIG. 1) provides the means to divide the first intermediate signal 62 into a third intermediate signal 68 and a fourth intermediate signal 70 each having the same relative phase as the first intermediate signal 62. Similarly, junction 50 provides the means to divide the first delayed signal 66 into a second delayed signal 72 and a third delayed signal 74 each having the same relative phase as the first delayed signal 66. Means 320 (FIG. 2*b*) then phase delays the fourth intermediate signal 70 ninety degrees resulting in the third delayed 74 and the fourth delayed 76 signals being in-phase with respect to each other, the combining and vectorial addition by means 330 results in a coherent coupled signal 78.

Various loads 400 (FIGS. 1 and 2*c*) can be attached to the output port 42 of the directional coupler 100 such as antennas, transmitting systems, a measurement device or the like. Each load 400 provides an impedance to the output signal 82, the impedance match between the output port 42 and the external load 400 determining the amplitude of a first reflected signal 84 (FIGS. 3*c* and 4).

Figure 3A:
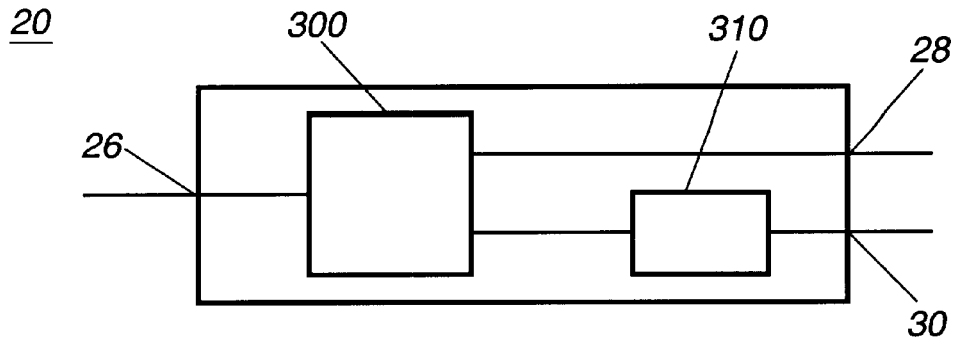
FIGS. 3*a–c* are second block diagrams of the first, second and third electrical members of the reflection reducing directional coupler in accordance with the invention of this application, illustrating the flow of reflected signals in the electrical members.
Figure 3B:
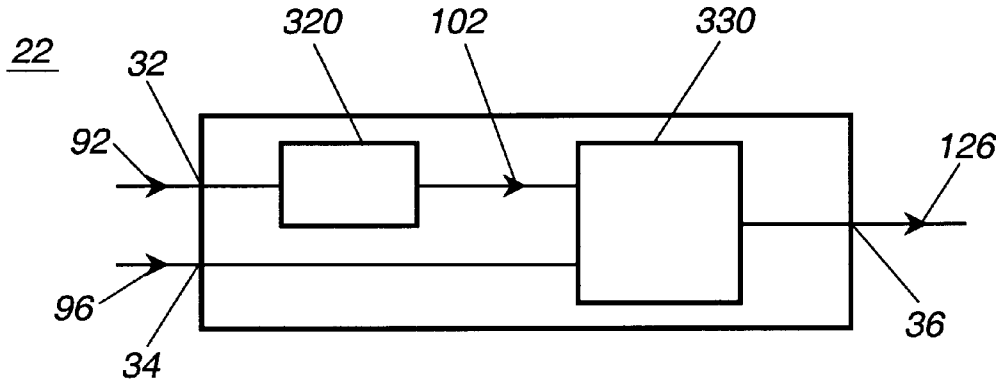
Figure 3C:
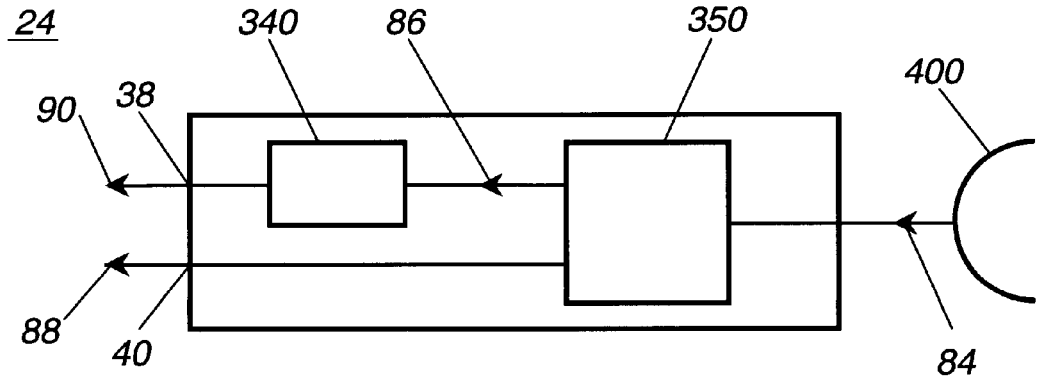

As shown in FIGS. 2*c* and 3*c*, the same means 350 used to combine the second delayed 72 and the fifth delayed 80 signals into an output signal 82 is utilized in the reverse direction and provides the means to divide the first reflected signal 84 into a second reflected signal 86 and a third reflected signal 88. Means 340 is utilized in the reverse direction to phase delay the second reflected signal 86 to generate a sixth delayed signal 90. The sixth delayed signal 90 is supplied to the seventh port 38 of the third electrical member 24; and, the third reflected signal 88 is supplied to the eighth port 40 of the third electrical member 24.

Figure 4:
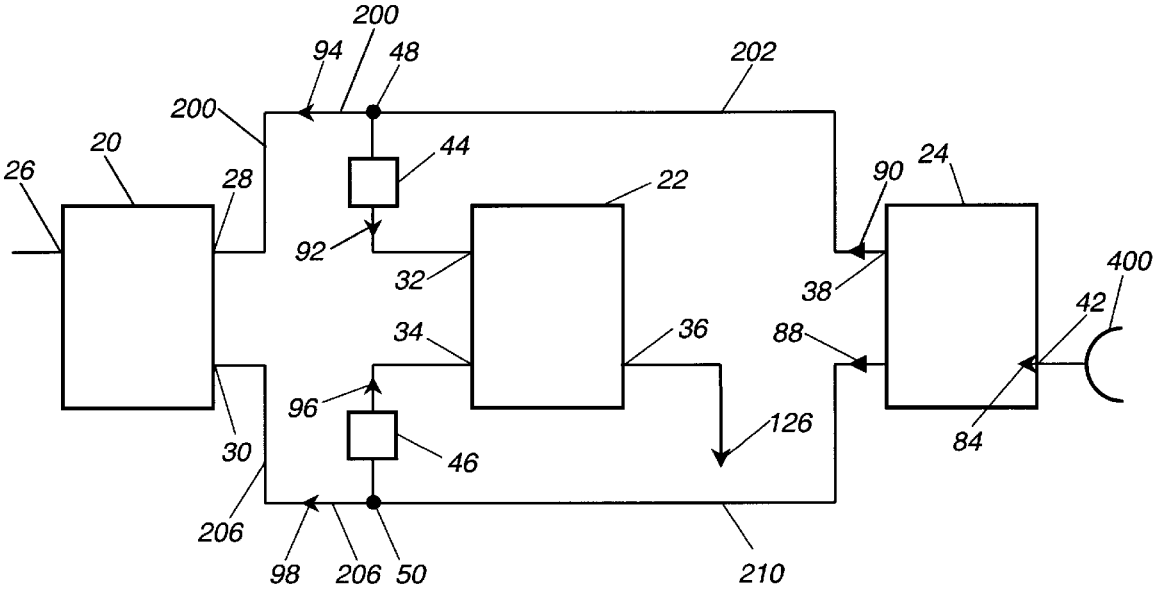
FIG. 4 is a second block diagram of the reflection reducing directional coupler in accordance with the invention of this application, illustrating the flow of reflected signals.

With reference to FIG. 4, the seventh port 38 of the third electrical member 24 is electrically connected to the fourth port 32 of the second electrical member 22 via line 202 and the first electrical component 44 and to the second port 28 of the first electrical member 20 via lines 202 and 200. The first junction 48, formed by the electrical connection of line 202 with both the first electrical component 44 and line 200, provides the means to divide the sixth delayed signal 90 into a seventh 92 and an eighth 94 delayed signal each having the same phase as the sixth delayed signal 90. Similarly, the eighth port 40 of the third electrical member 24 is electrically connected to the fifth port 34 of the second electrical member 22 via the second electrical component 46 and line 210 and to the third port 30 of the first electrical member 20 via lines 210 and 206. The second junction 50, formed by the electrical connection of line 210 with both the second electrical component 46 and line 206, provides the means to divide the third reflected signal 88 into a fourth reflected signal 96 and a fifth reflected signal 98 each having the same phase as the third reflected signal 88. The seventh delayed signal 92 and the fourth reflected signal 96 are input to the fourth port 32 and the fifth port 34 respectively of the second electrical member 22. The same means 320 (FIG. 2*b*) used to phase delay the fourth intermediate signal 70 is used to phase delay the seventh delayed signal 92 (FIG. 3*b*) to generate a ninth delayed signal 102. Similarly, the same means 330 (FIG. 2*b*) used to combine and vectorially add the third delayed 74 and fourth delayed 76 signals is used to combine and vectorially add the fourth reflected 96 (FIG. 3*b*) and ninth delayed 102 signals into a sixth reflected signal 126.

It is typically desirable to reduce the amplitude of the sixth reflected signal 126 as much as possible. Providing equal amplitude, one hundred and eighty degree out-of-phase fourth reflected 96 and ninth delayed 102 signals (FIG. 3*b*) will result in cancellation or near cancellation of these two signals upon combining and vectorial addition of the two signals. For this embodiment, means 350 (FIG. 3*c*) divides the first reflected signal into equal amplitude second reflected 86 and third reflected 88 signals. Next, means 340 phase delays the second reflected signal 86 ninety degrees to generate a sixth delayed signal 90 that is ninety degrees phase delayed with respect to the third reflected signal 88. Electrical components 44 and 46 (FIG. 4) are chosen to have equal electrical characteristics such that the first 48 and second 50 junctions provides the means to divide the sixth delayed 90 and the third reflected 88 signal into equal amplitude seventh delayed 92 and fourth reflected 96 signals and equal amplitude eighth delayed 94 and fifth reflected 98 signals. The seventh 92 and eighth 94 delayed signals have the same relative phase as the sixth delayed signal 90; and the fourth 96 and fifth 98 reflected signals have the same relative phase as the third reflected signal 88. Thus, the fourth reflected 96 and seventh delayed 92 signals have equal amplitudes; and, the seventh delayed signal 92 has a phase delay of ninety degrees with respect to the fourth reflected signal 96.

Means 320 (FIG. 3*b*) phase delays the seventh delayed signal 92 by an additional ninety degrees to generate a ninth delayed signal 102 that is one hundred and eighty degrees out-of-phase with respect to the fourth reflected signal 96. Means 330 vectorially adds the two out-of-phase signals resulting in cancellation or near cancellation of the fourth reflected 96 and ninth delayed 102 signals such that the amplitude of the sixth reflected signal 126 is reduced as much as possible.

Referring to FIG. 1, the first 20, second 22 and third 24 electrical members can be designed to divide signals and phase delay signals over a wide frequency band, a narrower frequency band, or primarily at a specific frequency. For one embodiment of the invention, the phase delays occur primarily over a frequency band of 10 to 20 Ghz. For another embodiment, the phase delays occur primarily at the specific frequency of 15 Ghz. For one embodiment of the invention, commercially available first, second, and third Lange couplers are used as the first 20, second 22 and third 24 electrical members. U.S. Pat. No. 3,516,024 was issued on Jun. 2, 1970 to Lange for an Interdigitated Stripline Coupler. This coupler has become known in the art as a Lange coupler. Lange couplers are a commercially known method of dividing a signal into two equal amplitude signals and phase delaying one of the signals ninety degrees with respect to the other signal. Lange couplers can be wideband or narrowband.

Figure 5:
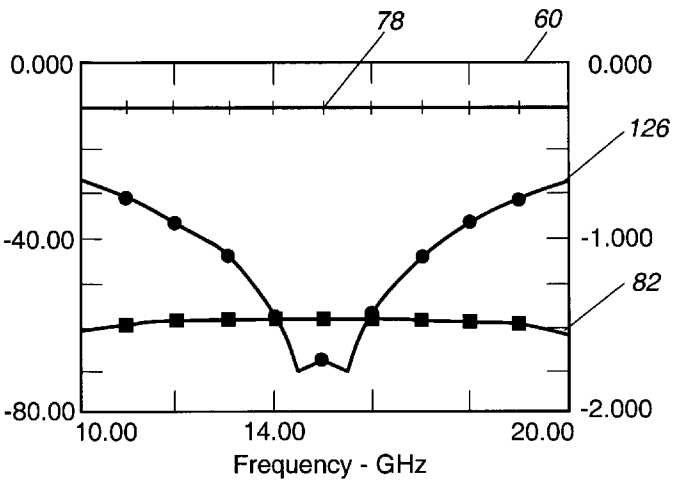
FIG. 5 depicts predicted signals present in the invention for first and second electrical components having a first resistance value.

FIG. 5 depicts the predicted signals present in the invention for first 44 and second 46 electrical components having a first resistance value of 85 ohms, with the first 20, second 22 and third 24 electrical members being first, second and third Lange couplers each having a relatively narrow bandwidth. The graphs are normalized for an input signal 60 (FIG. 1) having a amplitude of 0 dB. The coupled signal 78 is depicted by plus signs, the output signal 82 is depicted by squares; and, the sixth reflected signal 126 is depicted by the diamonds. The vertical scale is amplitude in decibels (dB) and the horizontal scale is frequency in Ghz. The vertical scale on the right side of the graph relates only to the graph of output signal 82. The vertical scale on the left side of the graph relates to the coupled signal 78 and the sixth reflected signal 126.

Figure 6:
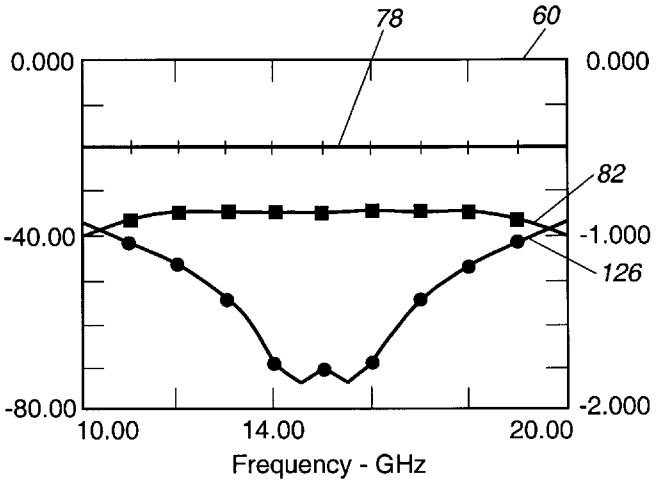
FIG. 6 depicts predicted signals present in the invention for first and second electrical components having a second resistance value.
Figure 7:
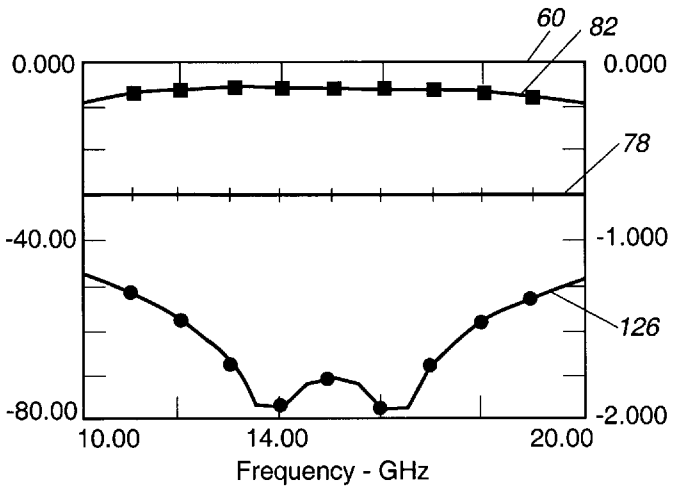
FIG. 7 depicts predicted signals present in the invention for first and second electrical components having a third resistance value.
Figure 8:
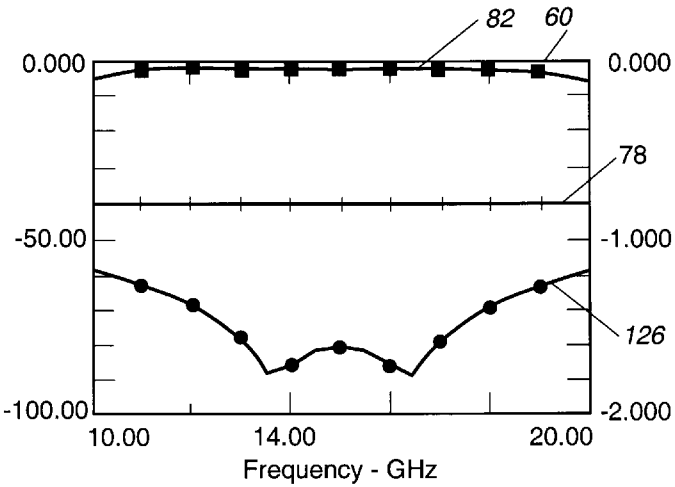
FIG. 8 depicts predicted signals present in the invention for first and second electrical components having a fourth resistance value.

The legends for FIGS. 6–8 are the same as for FIG. 5. FIG. 6 depicts the predicted signals present in the invention for first 44 and second 46 electrical components having a second resistance value of 430 ohms for an embodiment of the invention having narrowband first, second and third Lange couplers. FIG. 7 depicts the predicted signals present in the invention for first 44 and second 46 electrical component having a third resistance value of 1520 ohms for an embodiment of the invention having wideband first, second and third Lange couplers; and, FIG. 8 depicts the predicted signals present in the invention for first 44 and second 46 electrical component having a fourth resistance value of 4950 ohms for an embodiment of the invention having wideband first, second and third Lange couplers.

Figure 9:
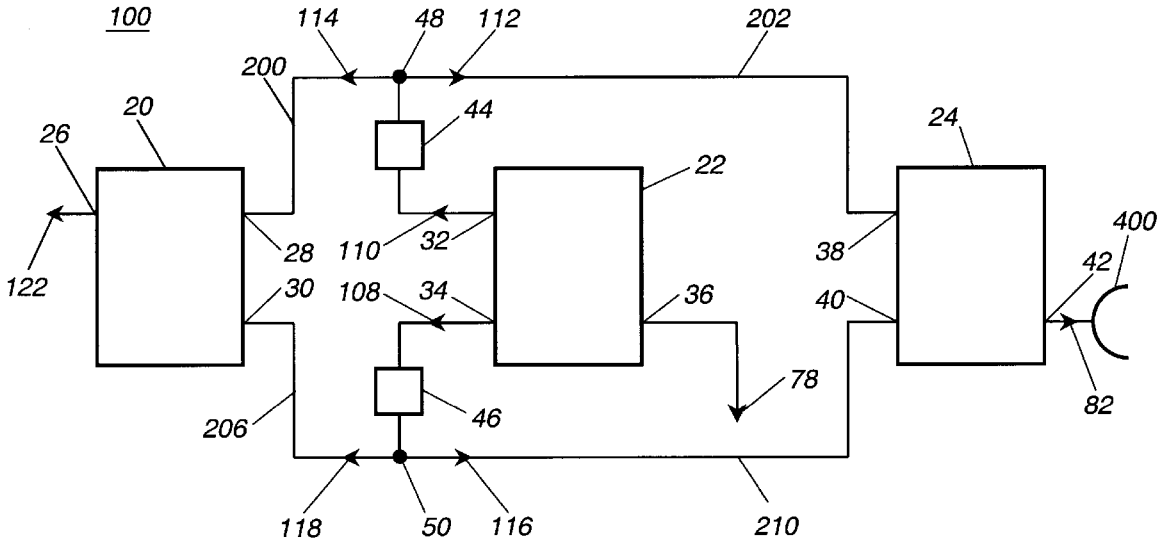
FIG. 9 is a third block diagram of the reflection reducing directional coupler in accordance with the invention of this application, illustrating the flow of signals resulting when a calibration signal is input into the coupler; and, FIGS. 10*a–c* are third block diagrams of the first, second and third electrical members of the reflection reducing directional coupler in accordance with the invention of this application, illustrating the flow of signals in the electrical members resulting when a calibration signal is input into the coupler.
Figure 10A:
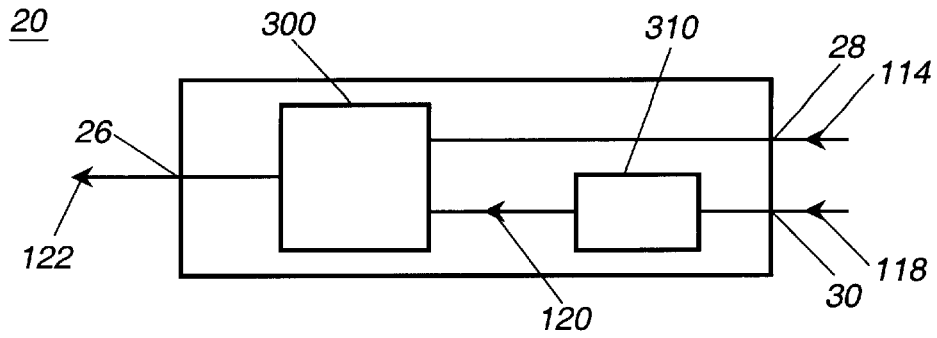
Figure 10B:
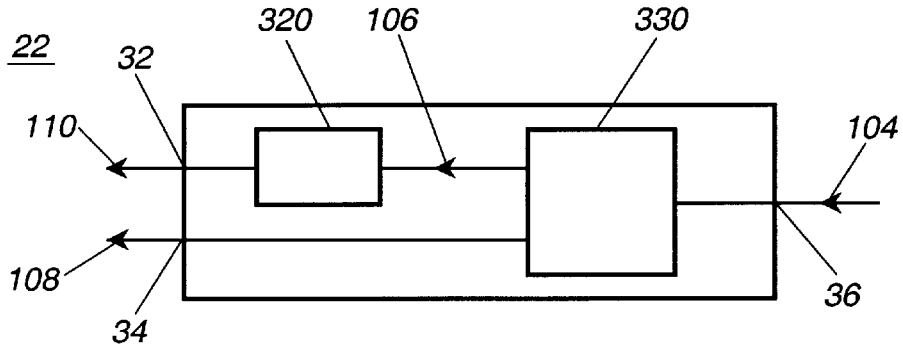

Referring now to FIG. 9, for various system applications, it is desirable to input a first calibration signal 104 into the RF system. The present invention can provide this capability. The coupled port 36 of the second electrical member 22 provides the means to input a first calibration signal 104 into the directional coupler 100. As shown in FIG. 10*b*, means 330 divides the first calibration signal 104 into a second calibration signal 106 and a third calibration signal 108, and means 320 phase delays the second calibration signal 106 to generate a fourth calibration signal 110. The fourth calibration signal 110 is supplied to the fourth port 32 of the second electrical member 22; and, the third calibration signal 108 is supplied to the fifth port 34 of the second electrical member 22.

Referring to FIG. 9, the fourth port 32 of the second electrical member 22 is electrically connected to the second port 28 of the first electrical member 20 via the first electrical component 44 and line 200 and to the seventh port 38 of the third electrical member 24 via the first electrical component 44 and line 202. The first junction 48, formed by the electrical connection of the first electrical component 44 with both line 200 and 202, provides the means to divide the fourth calibration signal 110 into fifth 112 and sixth 114 calibration signals each having the same phase as the fourth calibration signal 110. Similarly, the fifth port 34 of the second electrical member 22 is electrically connected to the third port 30 of the first electrical member 20 via the second electrical component 46 and line 206 and to the eighth port 40 of the third electrical member 24 via the second electrical component 46 and line 210. The second junction 50, formed by the electrical connection of the second electrical component 46 with both line 206 and line 210, provides the means to divide the third calibration signal 108 into a seventh 116 and an eighth 118 calibration signal each having the same phase as the third calibration signal 108. The fifth 112, sixth 114, seventh 116 and eighth 118 calibration signals are received at the seventh 38, second 28, eighth 40, and third 30 ports respectively.

Figure 10C:
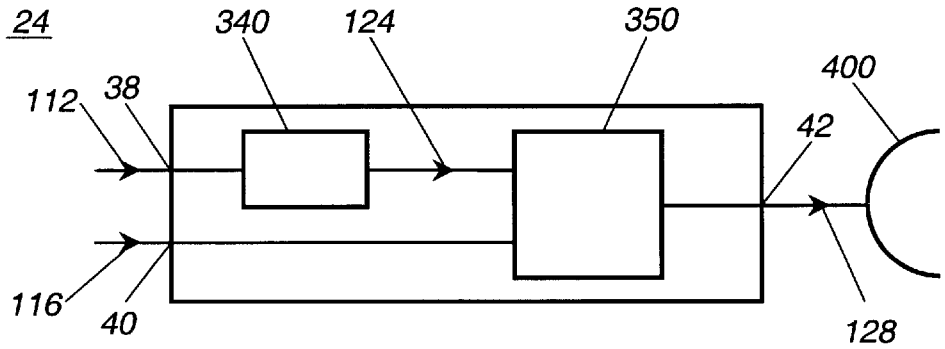

Means 310 (FIG. 10*a*) phase delays the eighth calibration signal 118 to generate a ninth calibration signal 120; and, means 300 combines and vectorially adds the sixth 114 and ninth 120 calibration signals into a first test signal 122. The first test signal 122 is supplied at the input port 26 of the first electrical member 20. Means 340 (FIG. 10*c*) phase delays the fifth calibration signal 112 to generate an eleventh calibration signal 124. Means 350 combines and vectorially adds the seventh 116 and eleventh 124 calibration signals into a twelfth calibration signal 128.

It is typically desirable to provide a coherent first test signal 122 (FIG. 9). With reference to FIG. 10*a*, providing sixth 114 and ninth 120 calibration signals that are in-phase with respect to each other allows for vectorial addition by means 300 of the sixth 114 and ninth 120 calibration signals into a coherent first test signal 122. To accomplish this, means 330 (FIG. 10*b*) divides the first calibration signal 104 into equal amplitude second 106 and third 108 calibration signals. Next, means 320 phase delays the second calibration signal 106 ninety degrees to generate a fourth calibration signal 110 that is ninety degrees phase delayed with respect to the third calibration signal 108. Junction 48 (FIG. 9) provides the means to divide the fourth calibration signal 110 into a fifth 112 and a sixth 114 calibration signal each having the same relative phase as the fourth calibration signal 110. Similarly, junction 50 provides the means to divide the third calibration signal 108 into a seventh 116 and an eighth 118 calibration signal each having the same relative phase as the third calibration signal 108.

Then, means 310 (FIG. 10*a*) phase delays the eighth calibration signal 118 ninety degrees to generate a ninth calibration signal 120 with the same relative phase as the sixth calibration signal 114. Combining and vectorial addition of the fourth calibration 110 and the ninth calibration 120 signals by means 300 results in a coherent test signal 122.

In addition to providing a coherent first test signal 122, it is also desirable to minimize the amplitude of the twelfth calibration signal 128 (FIG. 10*c*) that is output at the output port 42 of the third electrical member 24 so that the twelfth calibration signal 128 does not distort the output signal 82 (FIG. 2*c*). The closer the seventh 116 and eleventh 124 calibration signals are to being equal amplitude, one hundred and eighty degrees out-of-phase signals, the smaller will be the amplitude of the twelfth calibration signal 128 provided at the output port 42 upon vectorial addition of the seventh 116 and eleventh 124 calibration signals by means 350.

To accomplish this, means 330 (FIG. 10*b*) divides the first calibration signal 104 into equal amplitude second 106 and third 108 calibration signals. Means 320 phase delays the second calibration signal 106 ninety degrees to generate a fourth calibration signal 110 that is ninety degrees phase delayed with respect to the third calibration signal 108. Junction 48 (FIG. 9) provides the means to divide the fourth calibration signal 110 into a fifth 112 and a sixth 114 calibration signal each having the same relative phase as the fourth calibration signal 110. Similarly, junction 50 provides the means to divide the third calibration signal 108 into a seventh 116 and an eighth 118 calibration signal each having the same relative phase as the third calibration signal 108. Providing first 44 and second 46 electrical components having equal electrical characteristics provides the means to divide the third 108 and fourth 110 calibration signals in equal amplitude fifth 112 and seventh 116 calibration signals and equal amplitude sixth 114 and eighth 118 calibration signals.

Means 340 (FIG. 10*c*) phase delays the fifth calibration signal 112 an additional ninety degrees to generate an eleventh calibration signal 124 that is one hundred and eighty degrees out-of-phase with respect to the seventh calibration signal 116. The combining and vectorial addition by means 350 results in cancellation or near cancellation of the seventh 116 and eleventh 124 calibration signals resulting in a reduced amplitude twelfth calibration signal 128.

The present invention provides an output signal and a coupled signal from an input signal while reducing the effects of a reflected signal on the coupled signal providing for a more accurate measurement of the coupled signal and a more accurate determination of the amplitude of an output or input signal. In addition, this invention provides the capability to input a calibration signal into a system while minimizing the effects of the calibration signal on the output signal.

We claim as our invention:

1. A directional coupler for providing an output signal and a coupled signal from an input signal while reducing the effects of a reflected signal comprising:

means for inputting an input signal into an input port of said directional coupler;

means to divide said input signal into a first and a second intermediate signal;

means to phase delay said second intermediate signal to generate a first delayed signal;

means to divide said first intermediate signal into a third and a fourth intermediate signal;

means to divide said first delayed signal into a second and a third delayed signal;

means to phase delay said fourth intermediate signal to generate a fourth delayed signal;

means to combine and vectorially add said third delayed signal and said fourth delayed signal into a coupled signal;

means to output said coupled signal at a coupled port of said directional coupler;

means to phase delay said third intermediate signal to generate a fifth delayed signal;

means to combine and vectorially add said second delayed signal and said fifth delayed signal into an output signal;

means to output said output signal at an output port of said directional coupler, an impedance match between said output port and an external load attached to said output port determining an amplitude of a first reflected signal;

means to divide said first reflected signal into a second and a third reflected signal;

means to phase delay said second reflected signal to generate a sixth delayed signal;

means to divide said sixth delayed signal into a seventh delayed signal and an eighth delayed signal;

means to divide said third reflected signal into a fourth reflected signal and a fifth reflected signal;

means to phase delay said seventh delayed signal to generate a ninth delayed signal; and, means to combine and vectorially add said fourth reflected and ninth delayed signals.

2. A coupler according to claim 1, wherein said means to phase delay said third intermediate signal results in said second delayed signal and said fifth delayed signal being in-phase with respect to each other;

means to phase delay said fourth intermediate signal results in said third delayed signal and said fourth delayed signal being in-phase with respect to each other; and, said means to phase delay said seventh delayed signal results in said ninth delayed and fourth reflected signals being approximately 180 degrees out-of-phase with respect to each other.

3. A coupler according to claim 1, wherein said means to divide said input signal results in approximately equal amplitude first and second intermediate signals;

said means to divide said first intermediate signal and said first delayed signal results in equal amplitude third delay and fourth intermediate signals and equal amplitude third intermediate and second delayed signals;

said means to divide said first reflected signal results in equal amplitude second reflected and third reflected signals;

said means to divide said sixth delayed and third reflected signals results in equal amplitude seventh delayed and fourth reflected signals;

said means to phase delay said third intermediate signal results in said second delayed signal and said fifth delayed signal being in-phase with respect to each other;

means to phase delay said fourth intermediate signal results in said third delayed signal and said fourth delayed signal being in-phase with respect to each other; and, said means to phase delay said seventh delayed signal results in said ninth delayed and fourth reflected signals being approximately 180 degrees out-of-phase with respect to each other.

4. A coupler according to claim 1, wherein said means to divide said input signal results in approximately equal amplitude first and second intermediate signals;

said means to divide said first intermediate signal and said first delayed signal results in equal amplitude third delay and fourth intermediate signals and equal amplitude third intermediate and second delayed signals;

said means to divide said first reflected signal results in equal amplitude second reflected and third reflected signals;

said means to divide said sixth delayed and third reflected signals results in equal amplitude seventh delayed and fourth reflected signals;

said means to phase delay said second intermediate signal results in said first delayed signal being phase delayed ninety degrees with respect to said first intermediate signal;

said means to phase delay said fourth intermediate signal results in said third delayed signal and said fourth delayed signal being in-phase with respect to each other;

said means to phase delay said third intermediate signal results in said fifth delayed signal and said second delayed signal being in-phase with respect to each other;

said means to phase delay said second reflected signal results in said sixth delayed signal being phase delayed ninety degrees with respect to said second reflected signal; and, said means to phase delay said seventh delayed signal results in said ninth delayed signal being one hundred and eighty degrees out-of-phase with respect to said fourth reflected signal.

5. A coupler according to claim 1, wherein said phase delays occur over a frequency band.

6. A coupler according to claim 5, wherein said frequency band is 10 to 20 Ghz.

7. A coupler according to claim 1, wherein said phase delays occur at a specific frequency.

8. A coupler according to claim 7, wherein said specific frequency is 15 Ghz.

9. A coupler according to claim 1, further including means for inputting a first calibration signal into said coupled port of said directional coupler;

means to divide said first calibration signal into a second and third calibration signal;

means to phase delay said second calibration signal to generate a fourth calibration signal;

means to divide said fourth calibration signal into a fifth and sixth calibration signal;

means to divide said third calibration signal into a seventh and an eighth calibration signal;

means to phase delay said eighth calibration signal to generate a ninth calibration signal;

means to add said sixth and ninth calibration signals, means to phase delay said fifth calibration signal to generate an eleventh calibration signal; and, means to add said seventh calibration and said eleventh calibration signals.

10. A coupler according to claim 9, wherein said means to phase delay said eighth calibration signal results in said sixth calibration signal and said ninth calibration signal having the same relative phase; and, said means to phase delay said fifth calibration signal results in said eleventh calibration signal and said seventh calibration signal being one hundred and eighty degrees out-of-phase.

11. A coupler according to claim 9, wherein said means to divide said first calibration signal results in equal amplitude second and third calibration signal;

said means to divide said third and fourth calibration signals results in equal amplitude sixth and eighth calibration signals and equal amplitude fifth and seventh calibration signals;

said means to phase delay said second calibration signal results in said fourth calibration signal being ninety degrees phase delayed with respect to said third calibration signal;

said means to phase delay said eighth calibration signal results in said ninth calibration signal being ninety degrees phase delayed with respect to said eight calibration signal; and, said means to phase delay said fifth calibration signal results in said eleventh calibration signal being ninety degrees phase delayed with respect to said fifth calibration signal.

12. A coupler according to claim 9, wherein said phase delays occur over a frequency band.

13. A coupler according to claim 12, wherein said frequency band is 10 to 20 Ghz.

14. A coupler according to claim 9, wherein said phase delays occur at a specific frequency.

15. A coupler according to claim 14, wherein said specific frequency is 15 Ghz.

16. A directional coupler for providing an output signal and a coupled signal from an input signal while reducing the effects of a reflected signal comprising:

a first electrical member including an input port, a second port, and a third port, said input port being adapted for receiving an input signal, said first electrical member being configured to divide said input signal into a first intermediate signal and a second intermediate signal and to phase delay said first intermediate signal to generate a first delayed signal, said first intermediate signal provided at said second port of said first electrical member and said first delayed signal provided at said third port of said first electrical member;

a second electrical member including a fourth port, a fifth port, and a coupled port, said fourth port being electrically connected to said second port of said first electrical member, said fifth port being electrically connected to said third port of said first electrical member;

a third electrical member including a seventh port, an eight port, and an output port, said seventh port being electrically connected to said second port of said first electrical member said eighth port being electrically connected to said third port of said first electrical member, said electrical connections of said second and third electrical members to said first electrical member dividing said first intermediate signal into a third intermediate signal and a fourth intermediate signal, and, dividing said first delayed signal into a second delayed signal and a third delayed signal;

said fourth port of said second electrical member being adapted to receive said fourth intermediate signal and said fifth port of said second electrical member being adapted to receive said third delayed signal, said second electrical member being configured to phase delay said fourth intermediate signal to generate a fourth delayed signal, said second electrical member configured to combine and vectorially add said third delayed signal and said fourth delayed signals into a coupled signal, said coupled signal provided at said coupled port of said second electrical member;

said seventh port of said third electrical member being adapted to receive said third intermediate signal, said eighth port being adapted to receive said second delayed signal, said third electrical member configured to phase delay said third intermediate signal to generate a fifth delayed signal, said third electrical member configured to combine and vectorially add said second delayed and fifth delayed signals and provide an output signal, said output signal provided at said output port of said third electrical member an impedance match between said output port and an external load attached to said output port determining an amplitude of a first reflected signal;

said third electrical member configured to divide said first reflected signal into a second and a third reflected signal, said third electrical member configured to phase delay to said second reflected signal to generate a sixth delayed signal, said third reflected signal provided at said eighth port of said third electrical member, said sixth delayed signal provided at said seventh port of said third electrical member;

said electrical connection of said second and third electrical members to said first electrical member dividing said sixth delayed signal into a seventh delayed signal and an eighth delayed signal, and, dividing said third reflected signal into a fourth reflected signal and a fifth reflected signal; and, said fourth port of said second electrical member adapted to receive said seventh delayed signal, said fifth port of said second electrical member adapted to receive said fourth reflected signal, said second electrical member configured to phase delay said seventh delayed signal to generate a ninth delayed signal, said second electrical member configured to combine and vectorially add said fourth reflected and said seventh delayed signals.

17. A directional coupler as in claim 16, further including a first electrical component and a second electrical component, said first electrical component electrical connected to said fourth port of said second electrical member, said first electrical component also electrical connected to both said second port of said first electrical member and to said seventh port of said third electrical member, said second electrical component electrical connected to said fifth port of said second electrical member, said second electrical component also electrical connected to said third port of said first electrical member and to said eighth port of said third electrical member.

18. A directional coupler as in claim 17, wherein said first and second electrical components are active components approximately equal in electrical characteristics.

19. A directional coupler as in claim 17, wherein said first and second electrical components are directional couplers.

20. A directional coupler as in claim 17, wherein said first and second electrical components are resistors approximately equal in electrical characteristics.

21. A directional coupler as in claim 17, wherein said first electrical member is a first Lange coupler, said second electrical member is a second Lange coupler; and, said third electrical member is a third Lange coupler.

22. A directional coupler as in claim 17, wherein said phase delays occur over a frequency band.

23. A directional coupler as in claim 22, wherein said frequency band is 10 to 20 Ghz.

24. A directional coupler as in claim 17, wherein said phase delays occur at a specific frequency.

25. A directional coupler as in claim 24, wherein said specific frequency is 15 Ghz.

* * * * *